United States Patent [19]

Decima et al.

[11] 4,162,626

[45] Jul. 31, 1979

[54] ROLLING MILL

[75] Inventors: Elmer E. Decima, Pittsburgh; Albert T. Briggs, Tarentum, both of Pa.

[73] Assignee: Wean United, Inc., Pittsburgh, Pa.

[21] Appl. No.: 902,534

[22] Filed: May 3, 1978

[51] Int. Cl.[2] ..... B21B 31/10

[52] U.S. Cl. ..... 72/238

[58] Field of Search ..... 72/238, 239

[56] References Cited

U.S. PATENT DOCUMENTS

| | | | |
|---|---|---|---|
| 3,312,093 | 4/1967 | Stubbs et al. | 72/238 |
| 3,651,679 | 3/1972 | Shumaker | 72/239 |
| 3,695,080 | 10/1972 | Sevenich et al. | 72/238 |
| 3,738,142 | 6/1973 | Adair | 72/239 |

*Primary Examiner*—Milton S. Mehr

*Attorney, Agent, or Firm*—Daniel Patch; Suzanne Kikel

[57] ABSTRACT

A rolling mill of the four-high type wherein the lower work roll chocks are interconnected by runners to form a sled-like construction and the upper work roll assembly is supportable by the lower work roll assembly so that the two work roll assemblies may be changed as a unit. The runners are supported by tracks carried by the upper back up roll chocks when the upper back up roll chocks are raised to bring the tracks into supporting engagement with the runners arranged above the tracks.

11 Claims, 6 Drawing Figures

ROLLING MILL

The present invention relates to a rolling mill having several rolls arranged in what is commonly referred to as a four-high, type mill. The matter of providing for quick, efficient and economical changing of the rolls of such mills has always been of great concern to the mill operator. One area which in recent years has been given considerable attention is the construction of the bearing chocks of the rolls, the housings and the manner of supporting the rolls, either individually or as a unit during their movement into and out of the mill during roll changing. The many different configurations of housings and chocks add considerably to the problem and almost invariably necessitate special or custom designed equipment.

The present invention provides an economical and efficient approach to the problem that has for one of its primary objects the simplification of the design of the chocks, the housings, and the manner of supporting the work rolls during roll changing.

A second object of the present invention is to provide in a rolling mill or the like having a pair of work roll assemblies each including a pair of opposed bearing chocks, a pair of back up roll assemblies each including a pair of opposed bearing chocks in which one of said back up roll assemblies cooperate with one of said work roll assemblies and the other said back up roll assembly cooperates with the other work roll assembly, and an upright housing for receiving said work roll and back up roll assemblies with their axes arranged in a horizontal disposition, and means for raising and lowering the uppermost back up roll assembly relative to said lowermost back up roll assembly, the improvement comprising:

a frame having spaced apart parallel runners extending between and connected to the opposite sides of said opposed chocks of said lower work roll assembly, said runners having means on their lower surfaces for allowing said lower work roll chocks to be supported on movement into and out of said housing, a pair of spaced apart tracks constructed and arranged to extend between said opposed chocks of said lower work roll assembly in an overhung relationship with respect to a different one of said runners, strap means for each back up roll chock connected to the inside or the outside of the vertical surface thereof for carrying a different one of said tracks and adapted on movement of said upper back up roll chocks to bring said tracks into and out of supporting relationship with said runners, and means for allowing said lower work roll assembly to selectively support said upper work roll assembly so that when so supported and when said lower work roll assembly is supportable by said tracks, both said work roll assemblies as a unit can be inserted into or removed from said housing.

These objects, as well as other novel features and advantages of the present invention, will be better understood when the following description of a preferred embodiment is read along with the accompanying drawings of which:

FIG. 2A being broken in places and in both figures parts are omitted for clarity;

Figure 1A:
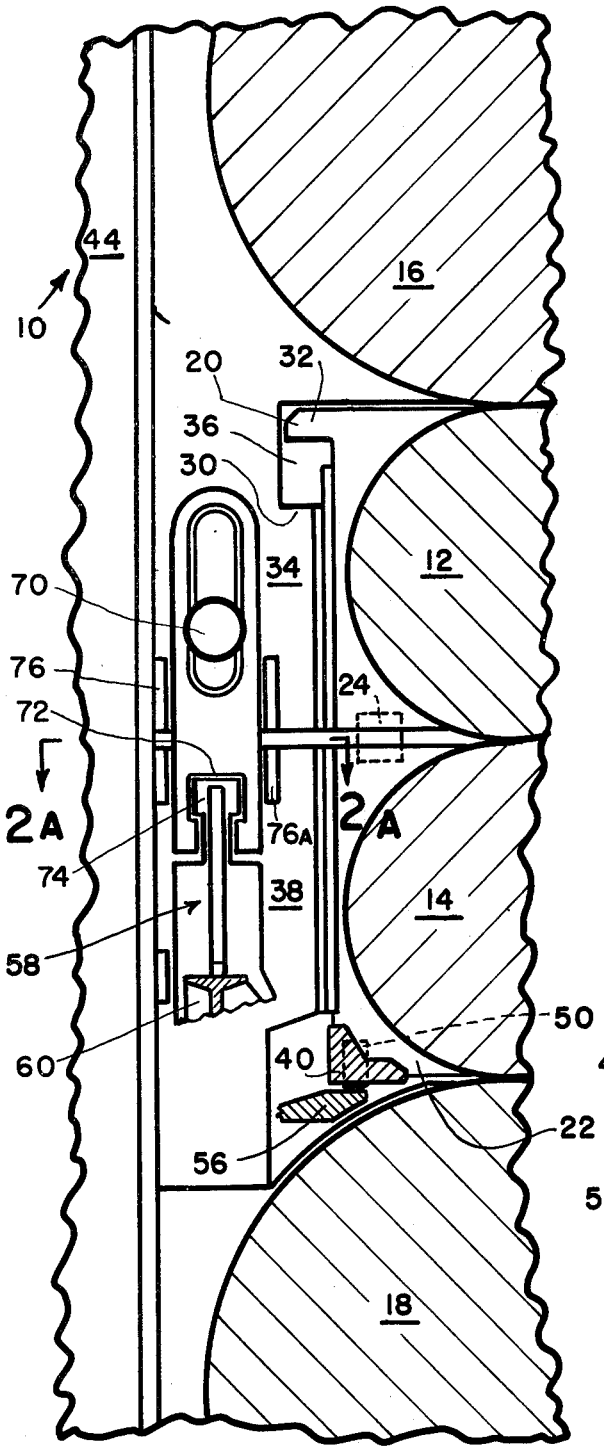
FIG. 1A is a sectional view taken on lines 1A—1A of FIG. 2A with parts being broken and others omitted for clarity, this figure illustrating the roll arrangement with minimum diameter rolls.
Figure 1B:
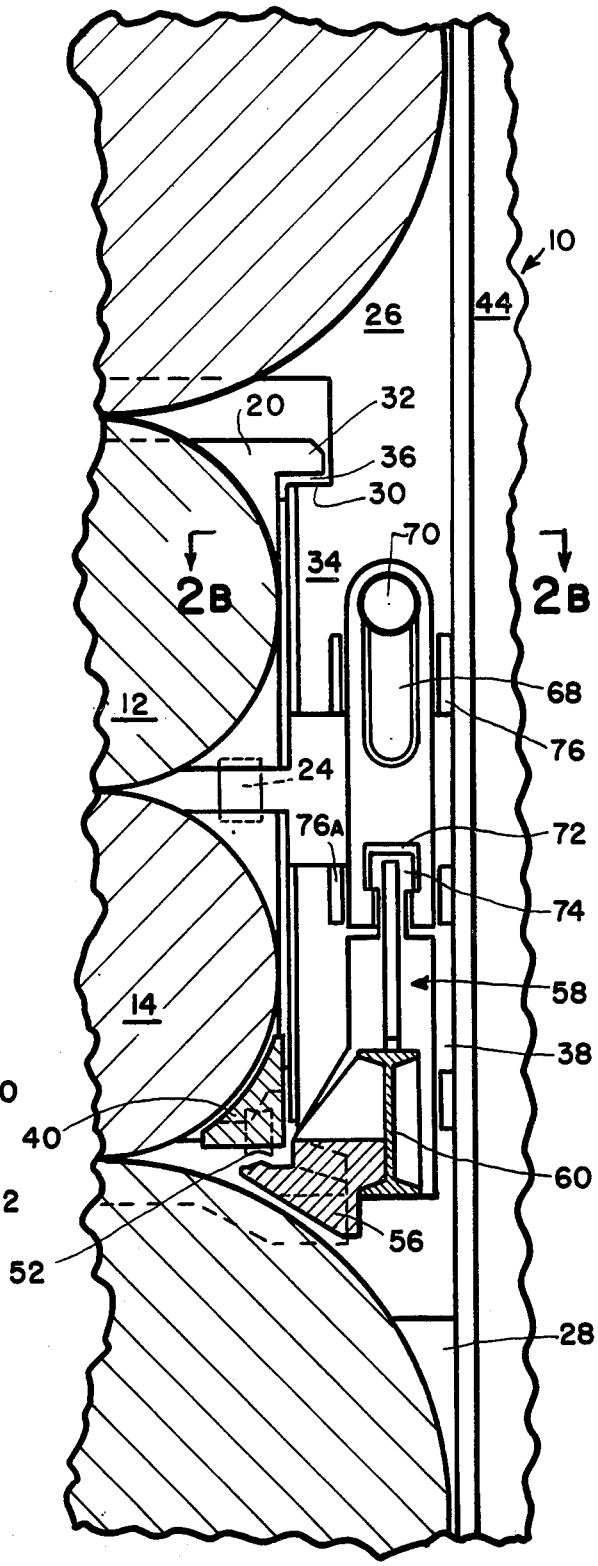
FIG. 1B is a sectional view taken on lines 1B—1B of FIG. 2B, again with parts being omitted, this figure illustrating the roll arrangement with maximum diameter rolls.

While the present invention may be applied to other multi-high mills, for purposes of illustration, a four-high mill has been chosen to describe and illustrate the present invention. FIGS. 1A and 1B illustrate a portion of the window layout for a four-high mill 10 when in its rolling condition, in counter-distinction to its roll changing condition where the rolls are separated from each other. Many of the more or less standard components of the mill 10 have not been shown as they are not deemed necessary to explain or understand the illustrated form of the invention. FIGS. 1A and 1B do show a pair of upper and lower work rolls 12 and 14 respectively, each having a supporting back up roll 16 and 18. The upper work roll has two bearing chocks (the operating side one being shown at 20), as does the lower work roll. Its operating bearing chock being designated at 22. These chocks, and the corresponding drive side chocks are urged apart by piston cylinder assembly balance cylinders 24.

The back up rolls 16 and 18 have bearing chocks, again only the operating side ones being shown and designated 26 and 28. Throughout this description, unless otherwise indicated, it may be assumed that the operating and drive side chocks are of the same basic construction. In a well known manner the upper back up bearing chocks are provided with a roll balance system, not shown, that urges both chocks 26 against cooperative mill screws, not shown.

The upper back up chocks 26 are associated with the upper work roll chocks 20 by horizontal projections 30 which engage cooperative projections 32 formed on the upper work roll chocks 20. The projections 30 are formed in downward extensions 34 formed in the lower portions of the upper back up chocks 26. The different clearances 36 indicated in FIGS. 1A and 1B between the projections 30 and 32 represent the maximum and minimum separations between the projections during rolling as defined by the two sets of designated diameters of rolls in the mill.

The lower back up roll 18 has a more or less fixed rotational axis both during rolling and during roll changing of the work rolls 12 and 14. The chocks 28 of the roll 18 also have extensions 38, which extend upwardly as one views FIGS. 1A and 1B. As will be explained more fully later on, during roll changing the lower work roll 14 is lifted off the lower back up roll 18 while the upper work roll 12 is both separated from the lower work roll 14 and the upper back up roll 16.

Figure 2A:
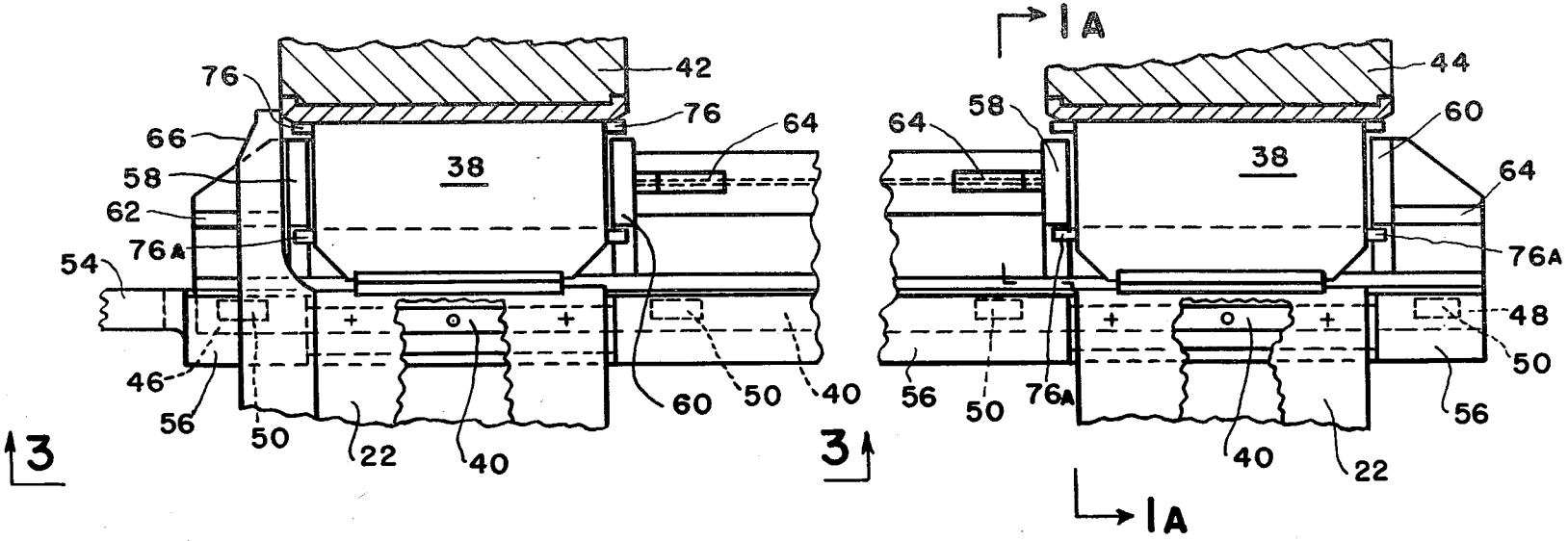
FIGS. 2A and 2B are sectional views taken on lines 2A—2A and 2B—2B, respectively of FIGS. 1A and 1B.

One of the basic considerations of the present invention in simplifying the changing of the work rolls as a unit is to construct the work rolls in the form of a sled in which the sled will be supported by the upper back up roll assembly in the manner that will assure effective and dependable roll changing. For this purpose and in referring in addition to FIGS. 1, 2 and 3, there is provided a pair of parallelly horizontally extending runners 40 physically connected to the lower surfaces of both lower work roll chocks 22, so that they interconnect the operating side work roll chock with the drive side work roll chock at the lower outside corners of these chocks. As shown in FIG. 2A, the runners extend not only between housing posts 42 and 44, but outwardly therefrom as indicated by the reference numbers 46 and 48.

The runners 40 in cross section take two different shapes. In one area where they engage the lower work roll chocks 22 they appear as shown in FIG. 1A, while otherwise they appear as shown in FIG. 1B where the cross section is considerably heavier. The runner 40 shown in FIG. 1A is provided with four flat rollers while the runner shown in FIG. 1B is provided also with four rollers having a groove for proper guidance. These rollers as shown in FIG. 2A are spaced so that they fall on either side of the two housing posts. At the front of the runners, as best shown in FIG. 2A, each runner is provided with a hook member 54 for the purpose of allowing the runners to be engaged by a work roll extractor means, not shown, but which can take the form of several well known devices.

The runners 40 are designed to be selectedly in unison supported by cooperative tracks 56 in which FIG. 2A shows one of the tracks being arranged directly beneath the rollers 50 and that this track extends axially of the roll 14 the same distance that the runners extend, i.e., as shown in FIG. 2A from the outside of the operating side of housing post 42 to the outside of the drive side of housing post 44. The tracks, as in the case of the runners have two different cross sections, in the area where they pass under the lower work roll chocks 22, as shown in FIG. 1A, and otherwise as shown in FIG. 1B where the tracks have a much heavier cross section.

Figure 2B:
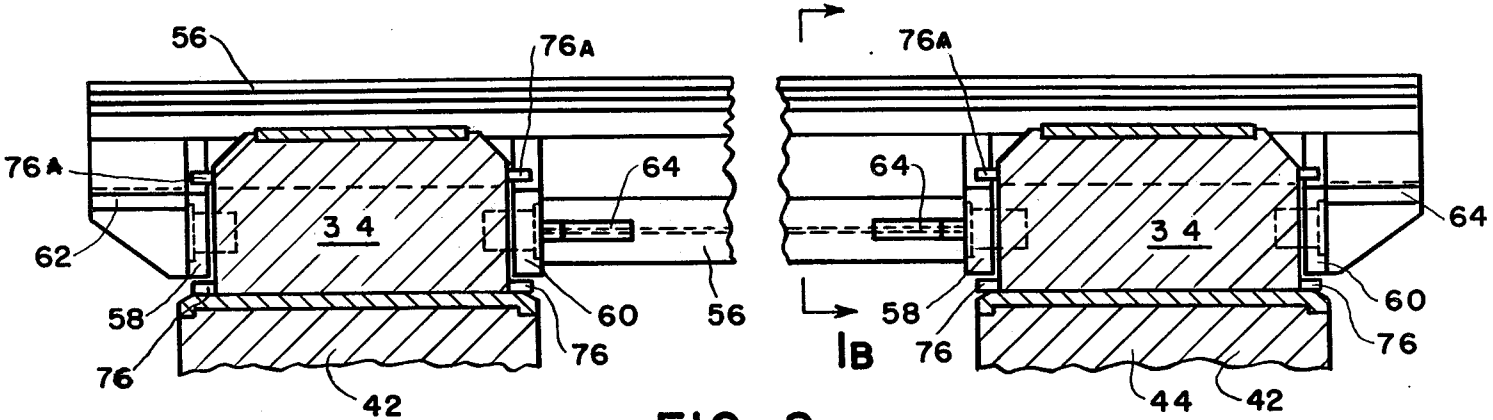

As noted above, the tracks 56 are adapted to be raised and lowered relative to the runners 40, FIGS. 1A and 1B showing the tracks in their lowermost non-supporting position. This track movement is accomplished by connecting each track to both back up roll chocks 26 at four different points. This is done by providing a pair of straps 58 and 60 for each opposed set of projections 34 and 38 of the upper and lower back up roll chocks 26 and 28 respectively. These straps are arranged to extend vertically parallel to the projections but on the outside and inside thereof adjacent to their vertical surfaces. This construction is best seen in FIGS. 2A and 2B which also give an indication of the four areas of support for the tracks and particularly the reduction of the extent of the cantilever effect of any supported area of the track outside of either of the housing posts 42 or 44.

Figure 3:
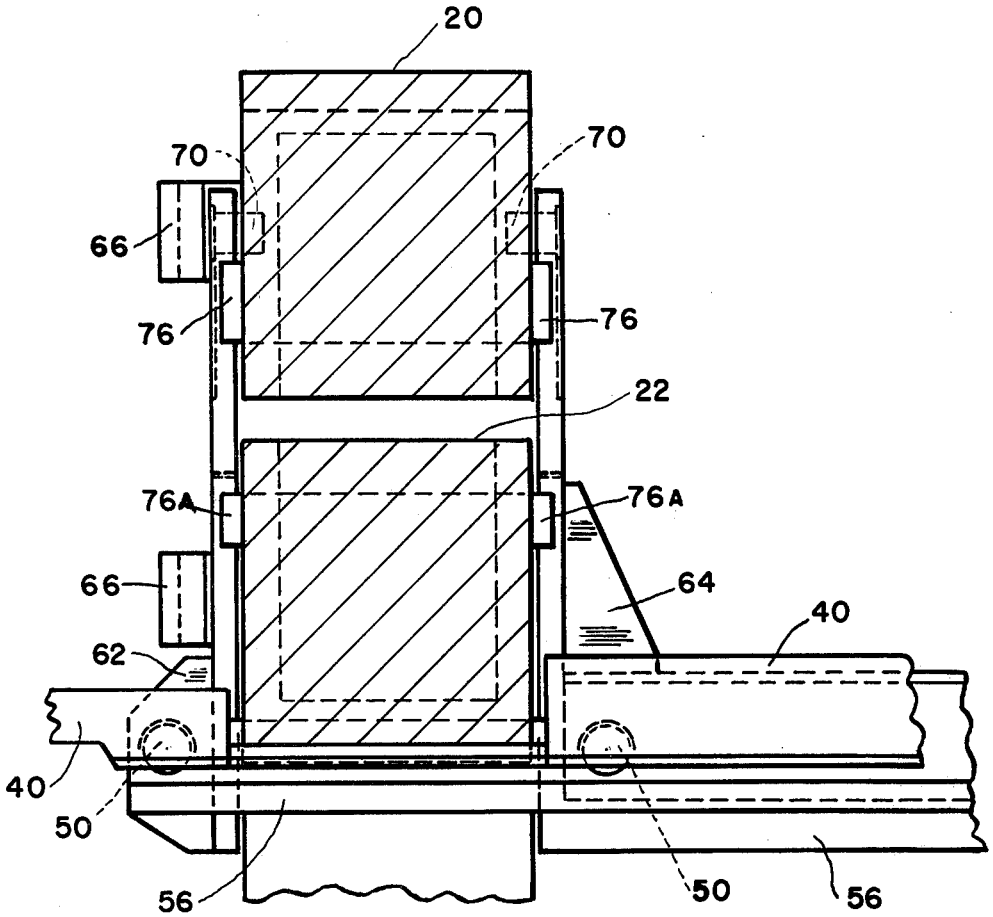
FIG. 3 is a sectional view taken on lines 3—3 of FIG. 2A, again certain parts being omitted for Clarity.

The lower portion of the straps take the form shown in FIGS. 1A and 1B where the tracks 56 are built up by a beam 60, which is given stiffness by ribs 62 and 64 as best shown in FIG. 3. The ribs 62 are reduced in height to make clearance for opposed pairs of wings of the work roll chocks, one of which is shown at 66 in FIG. 2A for the lower chock 22 while in FIG. 3 one wing of the upper and lower work roll chocks are shown. The ribs 64, i.e., the inside ribs, as one views FIG. 3 are joined to the adjacent portion of the tracks 56 that extend between the housing posts 42 and 44.

The upper portion of each strap 58 have an opening 68 which receives a horizontal extending pin 70 the outer ends of which have restraining covers secured to the projection 34 of the upper back up roll chock 26. The lower portion of the upper part of each strap has a square shaped opening 72 for receiving a complementary part 74 of the lower part of the strap 58. In this way, each pin 70 permits a certain amount of arcuate movement of the straps to assure proper registration between the rollers 50 and 52 and the tracks 56, and particularly the groove of the rollers 52 with the track 56. The broken connections of the straps formed by the openings 72 and parts 74 are provided in order to allow quick replacement and removal of the upper back up roll assembly 16 to and from the lower back up roll assembly 18 when these rolls have been removed from the mill and are being stacked and unstacked before and after assembly of the chocks 26 and 28 on their respective rolls. In this connection in referring to FIGS. 1A and 1B it will be observed that when the lower roll 18 is in its lowest position in the mill the upper surface of the parts 74 of the lower member of the straps 58 always fall below the upper surfaces of the projections 38 of the lower chocks 28. In this way there is avoided the possibility of the upper projections 34 of the upper chocks 26 damaging the lower strap members when the upper back up roll assembly is replaced or removed to and from the lower back up roll to form or disassemble a roll stack. The straps are restrained in the vertical direction by guide bars 76 shown in each of the aforesaid FIGURES.

The guide bars 76A shown in several of the FIGURES are made removable in order that the tracks 56 and the lower parts of the straps 58 can be removed from the lower chocks of the lower roll 18 so that the lower chocks can be removed from the roll 18. This requirement is more obvious when one observes in FIG. 2B that the tracks encircle the chocks.

During changing of the work rolls after the normal procedures and attending operations have been taken care of, the back up roll 16 and its chocks 26 are raised to bring the tracks 56 into a supporting relationship with their associated runners 40. Prior to this, the piston cylinder assemblies 24 are blocked if they are the type that allow for this function, or they are collapsed and stools are inserted between the work roll chocks 20 and 22. In this way the work rolls as a unit are supported by the tracks 56. At the front of the mill adjacent to the ends of the tracks 56, as one views FIGS. 2A and 2B, the work roll unit will be received by a platform or other well known supporting device.

When the back up rolls 16 and 18 are to be changed, they are normally changed after the work rolls 12 and 14 have been removed from the mill. In the arrangement shown the back up rolls are removed by a sled located in the bottom of the window in which the back up roll assemblies 16 and 18 with their chocks 26 and 28 respectively, and with the straps 58 and tracks 56 are removed as a unit.

Figure 4:
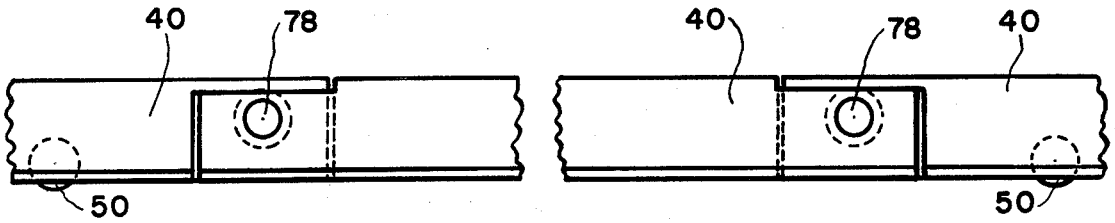
FIG. 4 is a second embodiment of the runners provided for the lower work roll assembly shown in the earlier figures.

Turning now to the second embodiment of the runners 40 illustrated in FIG. 4, there is shown that instead of the runners being made as continuous rigid pieces, the center pieces inside the housing posts 42 and 44 are provided with pins 78 which allow the runners to pivot a controlled amount, thereby avoiding objectionable forces such as caused by roll deflections and roll bending independent of the sled or other conditions that would affect the effectiveness of the runners.

In accordance with the provisions of the patent statutes, we have explained the principle and operation of our invention and have illustrated and described what we consider to represent the best embodiment thereof.

We claim:

1. In a rolling mill or the like having a pair of work roll assemblies each including a pair of opposed bearing chocks, a pair of back up roll assemblies each including a pair of opposed bearing chocks in which one of said back up roll assemblies cooperate with one of said work roll assemblies and the other said back up roll assembly cooperates with the other work roll assembly and the upright housing for receiving said work roll and back up roll assemblies with their axes arranged in a horizontal disposition, and means for raising and lowering the uppermost back up roll assembly relative to said lowermost back up roll assembly, the improvement comprising:

a frame having spaced apart parallel runners extending between and connected to the opposite sides of said opposed chocks of said lower work roll assembly, said runners having means on their lower surfaces for allowing said lower work roll chocks to be supported on movement into and out of said housing, a pair of spaced apart tracks constructed and arranged to extend between said opposed chocks of said lower work roll assembly in an overhung relationship with respect to a different one of said runners, strap means for each back up roll chock connected to the inside or the outside of the vertical surface thereof for carrying a different one of said tracks and adapted on movement of said upper back up roll chocks to bring said tracks into and out of supporting relationship with said runners, and means for allowing said lower work roll assembly to selectively support said upper work roll assembly so that when so supported and when said lower work roll assembly is supportable by said tracks, both said work roll assemblies as a unit can be inserted into or removed from said housing.

2. In a rolling mill according to claim 1 wherein each of said runners is formed in at least three cooperative sections, and pivotal connecting means for pivotally connecting adjacent sections of said runners.

3. In a rolling mill or the like according to claim 1 wherein said back up bearing chocks have pairs of similar projections forming two openings for receiving a different cooperative pair of said work roll chocks, wherein said housing includes a pair of parallelly arranged spaced apart housing posts, and wherein said strap means includes a pair of strap members carried by the inside and outside vertical surfaces of each projection of said back up roll chocks, and means for connecting said strap members to the inside and outside of each projection in a manner that each track is supported in at least four different locations along its longitudinal axes and immediately adjacent the adjacent surface of an associated housing post.

4. In a rolling mill according to claim 3 wherein each said strap member includes an upper and lower element, said connecting means including a pin for pivotally supporting each upper element and carried by the associated surface of said projection of an associated upper back up roll chock, other connecting means for connecting said elements together in a manner to allow easy disconnection therebetween, and means for connecting said lower elements to an associated track.

5. In a rolling mill according to claim 3 wherein for each runner there is provided two pairs of cooperative wheels adapted to be mounted on the inside and outside of an associated housing post when the work roll assemblies are in said mill and constructed and arranged to engage their associated tracks.

6. In a rolling mill according to claim 3 wherein said tracks extend continuously from a point on the outside of one housing post to a corresponding point on the outside of the other housing post and wherein said runners extend continuously from a point on the outside of one housing post to a corresponding point on the outside of the other housing post.

7. In a rolling mill or the like having a pair of work roll assemblies each including a pair of opposed bearing chocks, a pair of back up roll assemblies each including a pair of opposed bearing chocks in which one of said back up roll assemblies cooperate with one of said work roll assemblies and the other said back up roll assembly cooperates the the other work roll assembly, and an upright housing for receiving said work roll and back up roll assemblies with their axes arranged in a horizontal disposition, and means for raising and lowering the uppermost back up roll assembly relative to said lowermost back up roll assembly, the improvement comprising:

said lower work roll chocks having means on their lower surface for allowing said lower work roll chocks to be supported on movement into and out of said housing, a pair of spaced apart tracks constructed and arranged to extend between said opposed chocks of said lower work roll assembly in an overhung relationship with respect to a different one of said supportable means of said lower work roll chocks, strap means for each back up roll chock connected to the inside or the outside of the vertical surface thereof for carrying a different one of said tracks and adapted on movement of said upper back up roll chocks to bring said tracks into and out of supporting relationship with said lower work roll chocks, and means for allowing said lower work roll assembly to selectively support said upper work roll assembly so that when so supported and where said lower work roll assembly is supported by said tracks, both said work roll assemblies as a unit can be inserted into or removed from said housing.

8. In a rolling mill according to claim 7 wherein each said strap member includes an upper and lower element, said connecting means including a pin for pivotally supporting each upper element and carried by the associated surface of said projection of an associated upper back up roll chock, other connecting means for connecting said elements together in a manner to allow easy disconnection therebetween, and means for connecting said lower elements to an associated track.

9. In a rolling mill or the like according to claim 7 wherein said back up bearing chocks have pairs of similar projections forming two openings for receiving a different cooperative pair of said work roll chocks, wherein said housing includes a pair of parallelly arranged spaced apart housing posts, and wherein said strap means includes a pair of strap members carried by the inside and outside vertical surfaces of each projection of said back up roll chocks, and means for connecting said strap members to the inside and outside of each projection in a manner that each track is supported in at least four different locations along its longitudinal axes and immediately adjacent the adjacent surface of an associated housing post.

10. In a rolling mill according to claim 9, guide means for each said member secured to an associated projection for allowing vertical movement thereof but restricting movement in the horizontal direction, at least some of said guide means being removable to permit said tracks to be removed from said associated back up roll assembly.

11. In a rolling mill according to claim 9 wherein each said strap member includes an upper and lower element, the construction and relationship of each said upper and lower element being such that said associated upper element is removable from its associated lower element and said lower element always falls below the uppermost surface of its associated projections.

* * * * *

UNITED STATES PATENT AND TRADEMARK OFFICE

CERTIFICATE OF CORRECTION

PATENT NO. : 4,162,626

DATED : July 31, 1979

INVENTOR(S) : Elmer E. Decima and Albert T. Briggs

It is certified that error appears in the above-identified patent and that said Letters Patent are hereby corrected as shown below:

Column 2, line 10, "Clarity" should read --clarity--

Column 6, line 23, "the the" should read -- with the --

Column 6, line 47, "where" should read -- when --

Signed and Sealed this

*Twenty-third* Day of *October 1979*

[SEAL]

*Attest:*

RUTH C. MASON
*Attesting Officer*

LUTRELLE F. PARKER
*Acting Commissioner of Patents and Trademarks*